US008987182B2

(12) United States Patent
Warkotsch et al.

(10) Patent No.: US 8,987,182 B2
(45) Date of Patent: Mar. 24, 2015

(54) SPHERICAL TOILET CLEANER BLOCKS, METHOD FOR THE PRODUCTION THEREOF, AND CLEANING HOLDER COMPRISING SPHERICAL TOILET CLEANER BLOCKS

(75) Inventors: Nadine Warkotsch, Munich (DE); Brigitte Giesen, Dusseldorf (DE); Anke Ernst, Leichlingen (DE); Sascha Schrecker, Dusseldorf (DE); Christian Reichert, Grevenbroich (DE); Ralph Butter-Jentsch, Langenfeld (DE); Hans-Georg Muhlhausen, Dusseldorf (DE); Robert Stephen Cappleman, Duisburg (DE); Michael Horn, Dusseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 174 days.

(21) Appl. No.: 13/292,620

(22) Filed: Nov. 9, 2011

(65) Prior Publication Data

US 2012/0047640 A1 Mar. 1, 2012

Related U.S. Application Data

(63) Continuation of application No. PCT/EP2010/056239, filed on May 7, 2010.

(30) Foreign Application Priority Data

May 13, 2009 (DE) ..... 10 2009 003 088

(51) Int. Cl.

| | |
|---|---|
| ***C11D 17/00*** | (2006.01) |
| ***C11D 1/83*** | (2006.01) |
| ***C11D 3/50*** | (2006.01) |
| ***E03D 9/03*** | (2006.01) |
| *C11D 1/14* | (2006.01) |
| *C11D 1/22* | (2006.01) |

(52) U.S. Cl.

CPC ..... *C11D 17/0056* (2013.01); *C11D 1/83* (2013.01); *C11D 3/50* (2013.01); *E03D 9/032* (2013.01); *C11D 1/143* (2013.01); *C11D 1/22* (2013.01)

USPC ..... 510/191; 510/145; 510/156; 510/192

(58) Field of Classification Search

CPC ... C11D 11/0023; C11D 17/0056; C11D 1/12

USPC ..... 510/191, 192, 145, 156

See application file for complete search history.

(56) References Cited

U.S. PATENT DOCUMENTS

| | | | | |
|---|---|---|---|---|
| 7,585,825 | B2 * | 9/2009 | Artiga Gonzalez et al. | 510/101 |
| 2004/0072704 | A1 * | 4/2004 | Gerke et al. | 510/101 |
| 2009/0099382 | A1 * | 4/2009 | Gerke et al. | 556/464 |

FOREIGN PATENT DOCUMENTS

| | | | |
|---|---|---|---|
| DE | 4314659 | A1 | 11/1994 |
| DE | 102008028138 | A1 | 12/2009 |

(Continued)

OTHER PUBLICATIONS

PCT International Search Report (PCT/EP2010/056239) dated Aug. 30, 2010.

*Primary Examiner* — Gregory Webb

(74) *Attorney, Agent, or Firm* — David K. Benson

(57) ABSTRACT

A toilet cleaner composition containing perfume, at least one non-ionic surfactant, at least one alkylbenzene sulfonate, and at least one olefin sulfonate, is sufficiently malleable that it may be shaped into rotationally symmetrical toilet cleaner blocks, and in particular into spherical blocks, using a rolling machine or a press. The resulting rotationally-symmetrical toilet cleaner block may be part of a toilet cleaning system comprising at least one toilet cleaner block and at least one dispenser device for use in a toilet.

12 Claims, 4 Drawing Sheets

(56) References Cited

FOREIGN PATENT DOCUMENTS

| | | | |
|---|---|---|---|
| DE | 102008037723 | A1 | 2/2010 |
| EP | 0791047 | B1 | 12/1998 |
| EP | 2031047 | A1 | 3/2009 |
| WO | WO 2007/099313 | A1 | 9/2007 |

* cited by examiner

SPHERICAL TOILET CLEANER BLOCKS, METHOD FOR THE PRODUCTION THEREOF, AND CLEANING HOLDER COMPRISING SPHERICAL TOILET CLEANER BLOCKS

CROSS-REFERENCE TO RELATED APPLICATIONS

This application is a continuation of PCT Application Serial No. PCT/EP2010/056239, filed on May 7, 2010, which claims priority under 35 U.S.C. §119 to 10 2009 003 088.3 (DE), filed on May 13, 2009. The disclosures PCT/EP2010/056239 and DE 10 2009 003 088.3 are hereby incorporated by reference in their entirety.

FIELD OF THE INVENTION

The present invention generally relates to toilet cleaner blocks and in particular to a toilet cleaner block comprising perfume, at least one non-ionic surfactant, an alkylbenzene sulfonate, and at least one olefin sulfonate, wherein the block can be shaped in a rolling machine or a press into a rotationally symmetrical, particularly spherical, object. The invention also relates to a method for manufacture of the toilet cleaner block as well as a system comprising at least one such toilet cleaner and a release device.

BACKGROUND OF THE INVENTION

Toilet cleaner pieces, also known as toilet blocks, have long been employed under the toilet rim (so-called rim blocks) as well as in water tanks (in-tank blocks or cistern blocks) for cleaning, disinfecting, and perfuming of toilets. In this regard, the esthetics and the efficiency have become increasingly important in recent years. This led, for example, to the development of gel-like or liquid toilet fresheners that in some cases are offered in multi-chamber containers, thereby allowing the combination of a cleaning agent released when the toilet is flushed, along with a permanent room freshening.

Solid toilet blocks are still relevant in the marketplace. Solid blocks are typically manufactured by extrusion process followed by cutting into pieces to produce substantially rectangular shaped toilet rim blocks. These shapes may then be inserted into suitable baskets for use in the toilet.

A disadvantage of such rim blocks is that they swell from the water flowing into the basket, causing uneven erosion and loss of the original shape. Even after a short period of use, a relatively unaesthetic block remains.

Accordingly, it was desirable to formulate a shapely and aesthetic toilet block that is uniformly washed away and that swells up as little as possible throughout its total life span. Preferably the production of a toilet block should be carried out at the lowest possible temperature, particularly because high temperature processing leads to a loss of perfume oil.

SUMMARY OF THE INVENTION

It has now been surprisingly found that a formulation comprising perfume, at least one non-ionic surfactant, an alkylbenzene sulfonate, and at least one olefin sulfonate, allows for the manufacture of round (and hence aesthetically appealing) toilet blocks at temperatures of 30° C. and below. The resulting toilet blocks do not swell up and, due to their round shape, always exhibit a minimal exposed surface area. Thus, they are flushed away uniformly, retaining their original shape even after a large number of flushes.

Accordingly, the subject matter of the invention is a toilet cleaner block comprising perfume, at least one non-ionic surfactant, at least one alkylbenzene sulfonate and at least one olefin sulfonate, wherein the block is malleable into a rotationally symmetrical object in either a rolling machine or a press. In particular, it is possible to manufacture spherical toilet cleaner blocks with a high sphericity in accordance with the present invention.

The toilet cleaner block according to the invention may be used in a release device, for example a toilet basket. Accordingly, a further embodiment of this invention is a system comprising at least one toilet cleaner block made in accordance with the present invention and a release device.

DETAILED DESCRIPTION OF THE INVENTION

Figure 1:
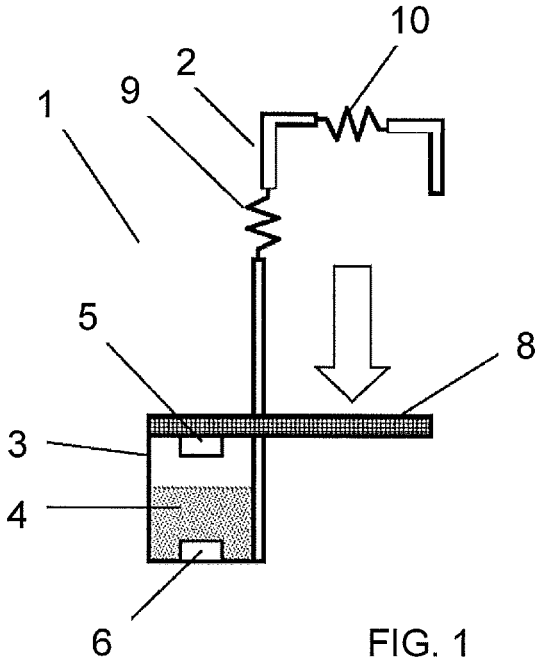
FIG. 1 illustrates a side view of a toilet basket with flush water distribution element above the inlet opening.

The present invention is a toilet cleaner block comprising (a) perfume; (b) at least one non-ionic surfactant; (c) at least one alkylbenzene sulfonate; and, (d) at least one olefin sulfonate, wherein the toilet cleaner block is malleable at low temperatures into a rotationally symmetrical object using a rolling machine or a press. As such, it is possible to manufacture spherical toilet cleaner blocks having a high sphericity.

The toilet cleaner block according to the invention can be manufactured in a process that includes the steps of mixing the ingredients, extruding the mixture, cutting the extruded strand into pieces of a defined mass, and molding into rotationally symmetric objects.

Accordingly, another embodiment of the invention is a process for manufacturing a rotationally symmetrical toilet cleaner block comprising perfume, non-ionic surfactant, alkylbenzene sulfonate and olefin sulfonate, said process comprising the steps of:

a) mixing the perfume and surfactant ingredients;
b) extruding the mixture;
c) cutting the extruded strand into pieces of a defined mass; and
d) molding into rotationally symmetric objects.

The inventive system comprising the toilet cleaner block and the release device may be employed in a process for cleaning and/or perfuming and/or disinfecting flush toilets. The inventive release device charged with the toilet cleaner block may be suspended in the toilet bowl such that when the toilet is flushed, the dissolved ingredients from the toilet cleaner block reach the flushing water, developing therein their cleaning and/or perfuming and/or disinfecting action.

Still another subject matter of the invention is a process for cleaning and/or perfuming and/or disinfecting flush toilets involving the use of a system comprising a toilet cleaner block according to the invention and a release device.

Substances that also serve as ingredients of cosmetics are hereafter, where appropriate, named in accordance with the International Nomenclature Cosmetic Ingredient (INCI) Nomenclature. Chemical compounds carry an INCI name in English, vegetal ingredients are listed exclusively according to Linne in Latin, so-called trivial names, such as "water", "honey" or "sea salt," are likewise recited in Latin. The INCI names are found in the International Cosmetic Ingredient Dictionary and Handbook, 7th Edition (1997), published by The Cosmetic, Toiletry and Fragrance Association (CTFA), 1101, 17th Street NW, Suite 300, Washington, D.C. 20036, USA, and comprises more than 9000 INCI names as well as more than 37,000 trade names and technical names including the associated distributors from more than 31 countries. The International Cosmetic Ingredient Dictionary and Handbook classifies the ingredients into one or more chemical classes, for example Polymeric Ethers, and into one or more functions, for example Surfactants—Cleansing agents, which are again mentioned in more detail and to which reference is likewise made, when necessary.

The indication "CAS" denotes that the series of numbers recited after the "CAS" designation relate to a name from the Chemical Abstracts Service.

In the context of the present invention, fatty acids or fatty alcohols or their derivatives—when not otherwise specified—represent branched or unbranched carboxylic acids or alcohols or their derivatives preferably containing 6 to 22 carbon atoms, particularly 8 to 20 carbon atoms, particularly preferably 10 to 18 carbon atoms, most preferably 12 to 16 carbon atoms, and for example, 12 to 14 carbon atoms. The first, due to their vegetal basis as well as being based on renewable raw materials, are particularly preferred, without however the inventive teaching being limited to them. Exemplary oxo alcohols or their derivatives which preferably contain 7 to 19 carbon atoms, particularly 9 to 19 carbon atoms, particularly preferably 9 to 17 carbon atoms, most preferably 11 to 15 carbon atoms, for example 9 to 11, 12 to 15 or 13 to 15 carbon atoms, and which are obtainable from Roelen's Oxo Synthesis, are also particularly suitably employable.

Perfume

The composition preferably comprises one or more fragrances in an amount of 0.01 to 10 wt %, preferably 0.05 to 8 wt %, particularly preferably 0.1 to 5 wt %. In this regard for example, d-limonene may be utilized as the perfume component. In a particularly preferred embodiment, the toilet cleaner block according to the invention comprises a perfume based on ethereal oils (also known as essential oils). In the context of this invention, pine-, citrus-, jasmin-, patchouly-, rose- or Ylang-Ylang-oil are exemplary oils. Also suitable are muscatel sage oil, chamomile oil, lavender oil, clove oil, melissa oil, mint oil, cinnamon leaf oil, lime blossom oil, juniper berry oil, vetivert oil, olibanum oil, galbanum oil and laudanum oil and orange blossom oil, neroli oil, orange peel oil and sandalwood oil.

The volatility of an odoriferous substance is crucial for its perceptibility, whereby in addition to the nature of the functional groups and the structure of the chemical compound, the molecular weight also plays an important role. Thus, the majority of odoriferous substances have molecular weights up to about 200 daltons, whereas molecular weights of 300 daltons and above are quite an exception. Due to the different volatilities of odoriferous substances, the smell of a perfume composed of a plurality of odoriferous substances changes during evaporation, the impressions of odor being subdivided into the "top note", "middle note" or "body" and "end note" or "dry out".

Exemplary tenacious odorous substances that are advantageously utilizable in the perfume oils in the context of the present invention are the ethereal oils such as angelica root oil, aniseed oil, arnica flowers oil, basil oil, bay oil, bergamot oil, champax blossom oil, silver fir oil, silver fir cone oil, elemi oil, eucalyptus oil, fennel oil, pine needle oil, galbanum oil, geranium oil, ginger grass oil, guaiacum wood oil, Indian wood oil, helichrysum oil, ho oil, ginger oil, iris oil, cajuput oil, sweet flag oil, camomile oil, camphor oil, Canoga oil, cardamom oil, cassia oil, Scotch fir oil, copaiba balsam oil, coriander oil, spearmint oil, caraway oil, cumin oil, lavender oil, lemon grass oil, limette oil, mandarin oil, melissa oil, amber seed oil, myrrh oil, clove oil, neroli oil, niaouli oil, olibanum oil, orange oil, origanum oil, Palma Rosa oil, patchouli oil, Peru balsam oil, petit grain oil, pepper oil, peppermint oil, pimento oil, pine oil, rose oil, rosemary oil, sandalwood oil, celery seed oil, lavender spike oil, Japanese anise oil, turpentine oil, thuja oil, thyme oil, verbena oil, vetiver oil, juniper berry oil, wormwood oil, wintergreen oil, ylang-ylang oil, ysop oil, cinnamon oil, cinnamon leaf oil, citronella oil, citrus oil and cypress oil.

However, in the context of the present invention, the higher boiling or solid fragrances of natural or synthetic origin can also be used as the tenacious fragrances or mixtures of fragrances in the perfume oils. These compounds include the following compounds and their mixtures: ambrettolide, α-amyl cinnamaldehyde, anethol, anisaldehyde, anis alcohol, anisole, methyl anthranilate, acetophenone, benzyl acetone, benzaldehyde, ethyl benzoate, benzophenone, benzyl alcohol, benzyl acetate, benzyl benzoate, benzyl formate, benzyl valeriate, borneol, bornyl acetate, α-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, methyl heptyne carboxylate, heptaldehyde, hydroquinone dimethyl ether, hydroxycinnamaldehyde, hydroxycinnamyl alcohol, indole, irone, isoeugenol, isoeugenol methyl ether, isosafrol, jasmone, camphor, carvacrol, carvone, p-cresol methyl ether, coumarone, p-methoxyacetophenone, methyl n-amyl ketone, methyl anthranilic acid methyl ester, p-methyl acetophenone, methyl chavicol, p-methyl quinoline, methyl β-naphthyl ketone, methyl n-nonyl acetaldehyde, methyl n-nonyl ketone, muscone, β-naphthol ethyl ether, β-naphthol methyl ether, nerol, nitrobenzene, n-nonyl aldehyde, nonyl alcohol, n-octyl aldehyde, p-oxyacetophenone, pentadecanolide, β-phenylethyl alcohol, phenyl acetaldehyde dimethyl acetal, phenyl acetic acid, pulegone, safrol, isoamyl salicylate, methyl salicylate, hexyl salicylate, cyclohexyl salicylate, santalol, scatol, terpineol, thymine, thymol, γ-undecalactone, vanillin, veratrum aldehyde, cinnamaldehyde, cinnamyl alcohol, cinnamic acid, ethyl cinnamate, benzyl cinnamate.

In the context of the present invention, the fragrances of higher volatility include the lower boiling fragrances of natural or synthetic origin that can be used alone or in mixtures. Exemplary readily volatile odoriferous substances include alkyl isothiocyanates (alkyl mustard oils), butanedione, limonene, linalool, linalyl acetate and linalyl propionate, menthol, menthone, methyl-n-heptenone, phellandrene, phenyl acetaldehyde, terpinyl acetate, citral, and citronellal.

Surfactants

The toilet cleaner block according to the present invention comprises at least one non-ionic surfactant, at least one alkylbenzene sulfonate, and at least one olefin sulfonate. In addition, the toilet cleaner block may comprise additional surfactants.

In this regard, the preferred alkylbenzene sulfonates are those that contain about 12 carbon atoms in the alkyl moiety, for example linear sodium $C_{10}$-$C_{13}$ alkylbenzene sulfonate. Preferred olefin sulfonates possess a carbon chain length of 14 to 16. The toilet cleaner block according to the invention comprises preferably 10 to 70 wt %, preferably 10 to 65 wt %, particularly preferably 20 to 30 wt % alkylbenzene sulfonate and preferably 10 to 30 wt %, preferably 15 to 30 wt %, particularly preferably 15 to 25 wt % olefin sulfate.

Nonionic Surfactants

Nonionic surfactants for use in the present invention may include alkoxylates such as polyglycol ethers, fatty alcohol polyglycol ethers, alkylphenol polyglycol ethers, end-capped polyglycol ethers, mixed ethers and hydroxy mixed ethers, and fatty acid polyglycol esters. Ethylene oxide/propylene oxide block polymers, fatty acid alkanolamides and fatty acid polyglycol ethers may also be used. Another important class of nonionic surfactants that may be used are the polyol surfactants and in particular the glycol surfactants, such as alkyl polyglycosides and fatty acid glucamides. The alkyl polyglycosides are particularly preferred, in particular the alkyl polyglucosides as well as above all the fatty alcohol alkoxylates (fatty alcohol polyglycol ethers).

Preferred fatty alcohol alkoxylates are unbranched or branched, saturated or unsaturated $C_8$-$C_{22}$ alcohols alkoxylated with ethylene oxide (EO) and/or propylene oxide (PO) with a degree of alkoxylation of up to 30, preferably ethoxylated $C_{12-22}$ fatty alcohols with a degree of ethoxylation of less than 30, preferably 12 to 28, particularly 20 to 28, particularly preferably 25, for example $C_{16-18}$ fatty alcohol ethoxylates containing 25 EO.

Alkyl polyglycosides are surfactants that can be obtained by the reaction of sugars and alcohols using appropriate methods of preparative organic chemistry, whereby according to the method of preparation, one obtains a mixture of monoalkylated, oligomeric or polymeric sugars. Preferred alkyl polyglycosides are the alkyl polyglucosides, wherein the alcohol is particularly preferably a long-chain fatty alcohol or a mixture of long-chain fatty alcohols with branched or unbranched $C_8$ to $C_{18}$ alkyl chains and the degree of oligomerization (DP) of the sugar is between 1 and 10, advantageously 1 to 6, particularly 1.1 to 3, most preferably 1.1 to 1.7, for example $C_{8-10}$ alkyl-1.5-glucoside (DP of 1.5).

Fatty alcohol ethoxylates are preferably employed in amounts of up to 20 wt %, particularly preferably 4 to 12 wt %, and particularly preferably from 7 to 9 wt %. Additional nonionic surfactants, such as fatty acid monoalkanolamides and/or alkyl polyglycosides, may be included in amounts of up to 10 wt %.

Additional Anionic Surfactants

Additional anionic surfactants for use in the toilet cleaner block may include, but are not limited to, aliphatic sulfates such as fatty alcohol sulfates, fatty alcohol ether sulfates, dialkyl ether sulfates, monoglyceride sulfates, and aliphatic sulfonates such as alkane sulfonates, ether sulfonates, n-alkyl ether sulfonates, ester sulfonates and lignin sulfonates. Fatty acid cyanamides, sulfosuccinates, particularly the $C_8$-$C_{18}$ alkyl mono and diesters of succinic acid, sulfosuccinamates, sulfosuccinamides, fatty acid isethionates, acylaminoalkane sulfonates (fatty acid taurides), fatty acid sarcosinates, ether carboxylic acids and alkyl (ether) phosphates as well as α-sulfofatty acid salts, acylglutamates, monoglyceride disulfates and alkyl ethers of glycerin disulfate can likewise be used in the context of the present invention.

The fatty alcohol sulfates and/or fatty alcohol ether sulfates, in particular the fatty alcohol sulfates, are preferred in the context of the present invention. Fatty alcohol sulfates are products from sulfating reactions on corresponding alcohols, whereas fatty alcohol ether sulfates are products of sulfating reactions on alkoxylated alcohols. In the context of the present invention, alkoxylated alcohols are generally understood by the person skilled in the art to mean the reaction products of alkylene oxide, preferably ethylene oxide, with alcohols, preferably with the longer chain alcohols. As a rule, n moles of ethylene oxide react with one mole of alcohol to form, depending on the reaction conditions, a complex mixture of addition products with different degrees of ethoxylation. Another embodiment of the alkoxylation consists in the use of mixtures of the alkylene oxides, preferably a mixture of ethylene oxide and propylene oxide. Preferred fatty alcohol ether sulfates are the sulfates of low-ethoxylated fatty alcohols with 1 to 4 ethylene oxide units (EO), in particular 1 to 2 EO, for example 1.3 EO.

The anionic surfactants are preferably added as their sodium salts, but can also be comprised of other alkali metal or alkaline earth metal salts. These include for example magnesium salts, as well as ammonium or mono, di, tri or tetraalkylammonium salts. In the case of the sulfonates, the acid form may be used, e.g. dodecylbenzene sulfonic acid.

Besides the previously cited surfactant types, the composition according to the invention may also comprise cationic surfactants and/or amphoteric surfactants.

Suitable amphoteric surfactants include for example betaines of the general formula $(R^{III})(R^{IV})(R^{V})N^{+}CH_2COO^{-}$, wherein $R^{III}$ denotes an alkyl group having 8 to 25, preferably 10 to 21, carbon atoms, optionally interrupted by heteroatoms or heteroatomic groups, and wherein $R^{IV}$ and $R^{V}$ denote the same or different alkyl groups having 1 to 3 carbon atoms. Such substances corresponding to the general formula include for example, $C_{10}$-$C_{18}$ alkyl dimethyl carboxymethyl betaine and $C_{11}$-$C_{17}$ alkylamidopropyl dimethylcarboxymethyl betaine.

Suitable cationic surfactants include, inter alia, the quaternary ammonium compounds of general formula $(R^{VI})(R^{VII})(R^{VIII})(R^{IX})N^{+}X^{-}$, in which $R^{VI}$ to $R^{IX}$ denote four identical or different types, in particular two long and two short chain alkyl groups, and wherein $X^{-}$ denotes an anion, especially a halide ion. Such substances corresponding to the general formula include for example didecyl-dimethylammonium chloride, alkyl-benzyl-didecylammonium chloride, and their mixtures.

Additional Ingredients

In addition to the previously cited components, the toilet cleaner block according to the invention may comprise additional ingredients typically employed in toilet cleaner blocks. These additional ingredients are preferably selected from the group consisting of acids, bases, salts, thickeners, antimicrobials, preservatives, sequestrants, colorants, scents, perfume boosters, fillers, builders, bleaching agents, corrosion inhibitors, flush regulators, enzymes, microorganisms, active substances for biofilm removal, lime-scale inhibitors, soil-adhesion inhibitors, and mixtures thereof. In total, not more than 60 wt % of additional ingredients should be included in the toilet block, preferably from 0.01 to 60 wt %, and in particular, 0.2 to 15 wt %.

Acids

Toilet cleaner blocks according to the invention may comprise one or more acids and/or their salts to increase the cleaning power against lime scale and urine scale. Organic acids, such as formic acid, acetic acid, citric acid, glycolic acid, lactic acid, succinic acid, adipic acid, malic acid, tartaric acid and gluconic acid as well as their mixtures are particularly suitable as the acids for the present invention. In addition, the mineral acids hydrochloric acid, sulphuric acid, phosphoric acid and nitric acid or even amido sulfonic acid or their mixtures can also be employed. The acids and/or their salts are preferably selected from the group consisting of citric acid, and lactic acid, any of their salts, and mixtures thereof. They are preferably employed in amounts of 0.01 to 10 wt %, and particularly preferably from 0.2 to 5 wt %.

In a preferred embodiment, the composition may additionally comprise inorganic salts. Such salts include alkali metal or alkaline earth metal salts, especially the carbonates, sulfates, halides, phosphates, and mixtures thereof. Sodium sulfate and/or sodium carbonate are preferably employed. In this regard, sodium sulfate may be included in an amount of up to 60 wt. %, preferably 0.01 to 60 wt. %, particularly preferably 20 to 60 wt %, and particularly from 35 to 55 wt. %. Sodium carbonate and other salts may be used in an amount of up to 30 wt %, preferably up to 10 wt %, and particularly preferably up to 5 wt. %.

Bases

Additionally, various alkalis may be included in the inventive compositions. Those alkaline materials selected from the group of alkali metal and alkaline earth metal hydroxides and carbonates, especially sodium carbonate or sodium hydroxide, are preferably employed in the present inventive compositions as bases. In addition however, ammonia and/or alkanolamines with up to 9 carbon atoms in the molecule can be used, preferably the ethanolamines, and especially monoethanolamine.

Antimicrobial Agents

Disinfection and sanitation represent a particular aspect of cleaning. Accordingly, in an additional embodiment of the invention, the toilet cleaner block according to the invention comprises one or more antimicrobial agents, preferably in an amount of 0.01 to 1 wt %, advantageously 0.02 to 0.8 wt %, especially 0.05 to 0.5 wt %, particularly preferably 0.1 to 0.3 wt %, and most preferably 0.2 wt %.

In the context of the inventive teaching, the terms disinfection, sanitation, antimicrobial action and antimicrobial agent have the usual technical meaning. Whereas disinfection in the strictest sense of medical practice means the killing of—theoretically all—infectious germs, in sanitation it is understood to mean the greatest possible elimination of all—even the saprophytic germs that are normally not harmful to humans. Here the degree of disinfection or sanitation depends on the antimicrobial action of the composition used which decreases with decreasing content of antimicrobial agent or increasing dilution of the composition used.

Inventively suitable exemplary antimicrobial agents are preferably selected from the group consisting of alcohols, amines, aldehydes, antimicrobial acids and salts thereof, carboxylic acid esters, acid amides, phenols, phenol derivatives, diphenyls, diphenylalkanes, urea derivatives, oxygen and nitrogen acetals and formals, benzamidines, isothiazolines, phthalimide derivatives, pyridine derivatives, antimicrobial surface-active compounds, guanidines, antimicrobial amphoteric compounds, quinolines, 1,2-dibromo-2,4-dicyanobutane, iodo-2-propinyl butyl carbamate, iodine, iodophores, compounds that split off active chlorine, peroxides, and mixtures thereof. Preferred antimicrobial agents are preferably selected from the group consisting of ethanol, n-propanol, i-propanol, 1,3-butanediol, phenoxyethanol, 1,2-propylene glycol, glycerin, undecylenic acid, citric acid, lactic acid, benzoic acid, salicylic acid, thymol, 2-benzyl-4-chlorophenol, 2,2'-methylene-bis-(6-bromo-4-chlorophenol), 2,4,4'-trichloro-2'-hydroxydiphenyl ether, N-(4-chlorphenyl)-N-(3,4-dichlorophenyl) urea, N,N'-(1,10-decanediyldi-1-pyridinyl-4-ylidene)bis-(1-octanamine)dihydrochloride, N,N'-bis-(4-chlorophenyl)-3,12-diimino-2,4,11,13-tetraazatetradecanediimidamide, antimicrobial quaternary surface active compounds, guanidine and sodium dichloroisocyanurate (DCI, 1,3-dichloro-5H-1,3,5-triazine-2,4,6-trione sodium salt), and mixtures thereof. Preferred antimicrobially active surface active quaternary compounds comprise an ammonium, sulfonium, phosphonium, iodonium or arsonium group. Furthermore, antimicrobially active ethereal oils can also be employed that simultaneously provide a perfuming benefit. Particularly preferred antimicrobial agents are selected from the group consisting of salicylic acid, quaternary surfactants, especially benzalkonium chloride, peroxy compounds, especially hydrogen peroxide, alkali metal hypochlorite, sodium dichloroisocyanurate, and mixtures thereof.

Preservatives

Preservatives may also be incorporated in toilet cleaner blocks according to the invention. Essentially, the substances cited above as antimicrobial agents may also function as preservatives.

Chelating Agents

The INCI term chelating agents, also known as sequestrants, are ingredients that are capable of complexing and inactivating metal ions so as to prevent their detrimental action on the stability or on the appearance of the agent, e.g. turbidity. It is important to complex the calcium and magnesium ions in hard water as they are incompatible with numerous ingredients. The complexation of the ions of heavy metals such as iron or copper also retards the oxidative decomposition of the finished composition. In addition, the chelating agents support the cleaning action.

The following exemplary chelating agents named according to INCI are suitable: aminotrimethylene phosphonic acid, beta-alanine diacetic acid, calcium disodium EDTA, citric acid, cyclodextrin, cyclohexanediamine tetraacetic acid, diammonium citrate, diammonium EDTA, diethylenetriamine pentamethylene phosphonic acid, dipotassium EDTA, disodium azacycloheptane diphosphonate, disodium EDTA, disodium pyrophosphate, EDTA, etidronic acid, galactaric acid, gluconic acid, glucuronic acid, HEDTA, hydroxypropyl cyclodextrin, methyl cyclodextrin, pentapotassium triphosphate, pentasodium aminotrimethylene phosphonate, pentasodium ethylenediamine tetramethylene phosphonate, pentasodium pentetate, pentasodium triphosphate, pentetic acid, phytic acid, potassium citrate, potassium EDTMP, potassium gluconate, potassium polyphosphate, potassium trisphosphonomethylamine oxide, ribonic acid, sodium chitosan methylene phosphonate, sodium citrate, sodium diethylenetriamine pentamethylene phosphonate, sodium dihydroxyethylglycinate, sodium EDTMP, sodium gluceptate, sodium gluconate, sodium glycereth-1 polyphosphate, sodium hexametaphosphate, sodium metaphosphate, sodium metasilicate, sodium phytate, sodium polydimethylglycinophenolsulfonate, sodium trimetaphosphate, TEA-EDTA, TEA-polyphosphate, tetrahydroxyethyl ethylenediamine, tetrahydroxypropyl ethylenediamine, tetrapotassium etidronate, tetrapotassium pyrophosphate, tetrasodium EDTA, tetrasodium etidronate, tetrasodium pyrophosphate, tripotassium EDTA, trisodium dicarboxymethyl alaninate, trisodium EDTA, trisodium HEDTA, trisodium NTA and trisodium phosphate.

Polymers

The toilet cleaner block according to the invention can further comprise polymers. They can act, for example, to reduce the formation of lime scale as well as the propensity to resoiling.

In this regard, preferred polymers are acrylic polymers, such as those commercially available from Rhodia under the trade name Mirapol®.

Fragrances and Colorants

The toilet cleaner block according to the invention can comprise one or more fragrances and/or one or more colorants as additional ingredients. Both water-soluble as well as oil-soluble colorants can be used as the colorants. In the selection of suitable colorants one has to take care of the compatibility with other ingredients present, for example bleaching agents, and one has to ensure added colorant does not substantively stain the toilet ceramics, even after long periods of action. The colorants are preferably incorporated in an amount of 0.0001 to 0.1 wt %, particularly in an amount of 0.0005 to 0.05 wt %, and particularly preferably from 0.001 to 0.01 wt %.

Builders

Water-soluble and/or water-insoluble builders can optionally be employed in the toilet cleaner blocks according to the invention. Here, water-soluble builders are preferred, as they generally have less of a tendency to leave behind insoluble residues on hard surfaces. Conventional builders which may be present in accordance with the invention include low molecular weight polycarboxylic acids and salts thereof, the homopolymeric and copolymeric polycarboxylic acids and salts thereof, citric acid and salts thereof, carbonates, phosphates and silicates. Water-insoluble builders include the zeolites, which can also be used, as well as mixtures of the above described builder substances.

Bleaching Agents

Bleaching agents may also be included to the toilet cleaner blocks of the present invention. Suitable bleaching agents include peroxides, peracids and/or perborates. Particularly preferably for use herein is hydrogen peroxide. In contrast, sodium hypochlorite is less suitable in acidic cleaning agents due to the release of poisonous chlorine gas vapor, but can be employed in cleaning agents adjusted to alkaline pH. In certain circumstances a bleach activator can also be used in addition to the bleaching agent.

Corrosion Inhibitors

Corrosion corrosion inhibitors are for example the following substances named according to INCI: Cyclohexylamine, Diammonium Phosphate, Dilithium Oxalate, Dimethylamino Methylpropanol, Dipotassium Oxalate, Dipotassium Phosphate, Disodium Phosphate, Disodium Pyrophosphate, Disodium Tetrapropenyl Succinate, Hexoxyethyl Diethylammonium, Phosphate, Nitromethane, Potassium Silicate, Sodium Aluminate, Sodium Hexametaphosphate, Sodium Metasilicate, Sodium Molybdate, Sodium Nitrite, Sodium Oxalate, Sodium Silicate, Stearamidopropyl Dimethicone, Tetrapotassium Pyrophosphate, Tetrasodium Pyrophosphate, Triisopropanolamine.

Flush Regulators

The substances designated as flush regulators act primarily to control the consumption of the agent during use in such a way that the intended lifetime is optimized. Solid long-chain fatty acids, such as stearic acid, are preferred regulators. Also fatty acid ethanolamides, such as coco fatty acid monoethanolamide, or solid polyethylene glycols, such as those having molecular weights between 10,000 and 50,000, are suitable flush regulators.

Adhesion Inhibitors

When manufacturing the toilet cleaner block according to the invention, an adhesion inhibitor can be added to improve the processability. Thus, the addition of dolomite powder or titanium dioxide powder of fine particle size distribution, improves the processability when shaping the product into spheres, and markedly reduces both attrition and tack.

The results with such agents are better than with other conventional measures, for example coating the sphere with a lubricant, dusting or coating the shaping rollers with Teflon.

Enzymes

The agent can also comprise enzymes, for example proteases, lipases, amylases, hydrolases and/or cellulases. The enzymes can be added to the inventive agent in each form established according to the prior art. These include solutions of the enzyme, advantageously as concentrated as possible, anhydrous and/or with added stabilizers. Alternatively, the enzymes can be encapsulated, for example by spray drying or extrusion of the enzyme solution together with a preferably natural polymer or in the form of capsules, for example those in which the enzyme is embedded in a solidified gel, or in those of the core-shell type, in which an enzyme-containing core is coated with a water-, air- and/or chemical-impervious protective layer. Further active principles, for example stabilizers, emulsifiers, pigments, bleaches or colorants can be applied in additional layers. Such capsules are made using known methods, for example by vibratory granulation or roll compaction or by fluidized bed processes. Advantageously, these types of granulates, for example with a coated polymeric film former, are dust-free and as a result of the coating are storage stable.

In addition, enzyme stabilizers can be present in the enzyme-containing agent, in order to protect an enzyme comprised in an agent according to the invention against damage such as for example inactivation, denaturing or decomposition for example by physical effects, oxidation or proteolytic cleavage. Each depending on the enzyme used, the following are suitable as enzyme stabilizers: benzamidine hydrochloride, borax, boric acid, boronic acids or their salts or esters, primarily derivatives containing aromatic groups, for example substituted phenylboronic acids or their salts or esters; peptide aldehydes (olgopeptides with reduced C-terminus), amino alcohols such as mono, di, triethanolamine and mono, di, tripropanolamine and their mixtures, aliphatic carboxylic acids up to C12, such as succinic acid, other dicarboxylic acids or salts of the cited acids, end blocked fatty acid amide alkoxylates; aliphatic lower alcohols and primarily polyols, for example glycerin, ethylene glycol, propylene glycol or sorbitol, as well as reducing agents and antioxidants such as sodium sulfite and reducing sugars. Further suitable stabilizers are known from the prior art. The use of combinations of stabilizers is preferred, for example the combination of polyols, boric acid and/or borax, the combination of boric acid or borate, reducing salts and succinic acid or other dicarboxylic acids or the combination of boric acid or borate with polyols or polyamino compounds and with reducing salts.

Multi-Layer Toilet Cleaning Blocks

It is known from the prior art, for example in EP 791047 B1, to manufacture toilet cleaner blocks from compounds of different compositions, wherein one of the compounds is totally or partially encapsulated by one or more of the other compounds. Thus for example, the inner compound can possess a higher perfume concentration than the outer compound in order to ensure a constant fragrance impression with a diminishing sphere weight over the service life of the product. The inner compound may also comprise a different fragrance than the outer compound. Alternatively, other active substances can also be incorporated in different layers such that they release at different times depending on the extent of flush. This type of layered construction is also possible for toilet cleaner blocks according to the invention.

Sphericity

Sphericity is defined as the degree to which a shape approaches that of a perfect sphere. Spherically shaped toilet cleaner blocks of the present invention preferably exhibit sphericity Ψ between 0.8 and 1, particularly preferably between 0.85 and 1, and quite particularly preferably between 0.9 and 1.

The sphericity Ψ of an object K is the ratio of the surface of the object to the surface of a perfect sphere of the same volume, and is calculated by the formula:

$$\Psi = \frac{\pi^{1/3}(6V_p)^{2/3}}{A_p}$$

wherein $V_p$ designates the volume of the object and $A_p$ designates its surface area.

Having almost a perfect spherical shape for the toilet cleaner block results in uniform erosion in use, such that the toilet cleaner block essentially maintains its spherical shape even during or after the flush process. It has been shown that a high sphericity Ψ of the toilet cleaner block prior to the impact of the flushing water is particularly important for the maintenance of the spherical shape during or after the flush process.

The diameter of the spherical toilet block is preferably between 1 mm and 10 cm, preferably between 5 mm and 5 cm, and especially between 1 cm and 3 cm.

The toilet cleaner block may be inserted into a release device that is fixed on the rim of the toilet bowl with a holder. Baskets with flushing water distribution elements are suitable for this, as described in the prior art, for example in DE 102008037723, and which can receive one or more toilet cleaner blocks. They are described in more detail in FIGS. 1 to 6. Secondly, one or more open plates can be used, onto which one or more toilet cleaner blocks are correspondingly fixed, as shown in FIG. 7. The toilet cleaner block and the release device together form a system. Such a system may be employed in a process for cleaning and/or perfuming and/or disinfecting flush toilets in such a way that the release device charged with the toilet cleaner block is suspended in the toilet bowl and when the toilet is flushed, the dissolved ingredients of the toilet cleaner block reach the flushing water and can develop therein their cleaning and/or perfuming and/or disinfecting action.

The release devices that are suitable for the toilet cleaner block according to the invention are described with reference to the drawings figures. In particular, the following elements are illustrated:

1-Release device;
2-Retaining element;
3-Container;
4-Toilet cleaner block;
5-Inlet;
6-Outlet;
7-Container wall;
8-Flush water distribution element;
9-Spring element;
10-Spring element;
11-Distributor element;
12-Receiver;
13-Connection;
14-Distal end;
15-Spike; and
16-Plate.

A first embodiment of the present invention is illustrated in FIG. 1. FIG. 1 shows a side view of a release device 1 for a toilet cleaner block 4 with flush water distribution element 8 configured above the inlet. The release device 1 consists of a container 3 that possesses an inlet 5 on its upper end, through which flush water can enter over the flush water distribution element 8 into the container 3. The flush water that entered the container 3 dissolves some of the toilet cleaner block 4 stored in the container 3, wherein the flush water that is now charged with the corresponding preparation leaves the container 3 through the outlet 6 and is thus dispensed into the interior of the toilet bowl.

In the particular embodiment illustrated, the flush water distribution element 8 is plate-shaped. Alternatively however, it may be shaped like a basin, slide or ramp for example, as well as any combination of these. The flush water distribution element 8 catches the flow of flush water of the toilet bowl, wherein the principal direction of flow of the flush water is downwards in the direction of gravity—as is shown by the large arrow. The flow of flush water is broken up by the flush water distribution element 8 that act similarly to a baffle plate, and is distributed over the surface of the flush water distribution element 8. The surface of the flush water distribution element 8 facing the flow of flush water can have liquid-channeling and/or liquid distributing structures, such as for example, grooves, capillaries, or gratings, which run crosswise and/or longitudinally.

The flush water distribution element 8 can also have an opening, through which flush water can flow into the inlet 5 of the container 3.

As can also be seen in FIG. 1, the toilet basket comprises a retaining element 2 by which the toilet basket can be removably placed by the consumer on the rim of a toilet bowl.

The retainer 2 has a first spring element 9 and a second spring element 10, wherein, in the inserted state of the toilet release device 1 in the toilet, the first spring element 9 has an essentially vertical spring deflection path and the second spring element 10 has an essentially horizontal spring deflection path, thereby enabling the toilet basket to be better and more flexibly fixed on toilets that have bowl rims of different thicknesses and designs.

Figure 2:
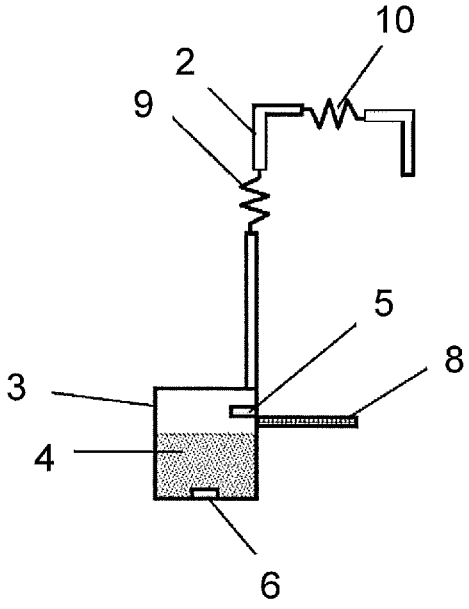
FIG. 2 illustrates a side view of a toilet basket with flush water distribution element below the inlet opening.

An alternative embodiment of a toilet basket for the toilet cleaner block of the present invention, with the flush water distribution element arranged below the inlet, is shown in FIG. 2. This embodiment of the release device 1 comprises a plate-like flush water distribution element 8 that, in the installed state of the release device 1 in a toilet bowl, extends directly below the inlet 5 of the container 3 towards the toilet rim.

Figure 3:
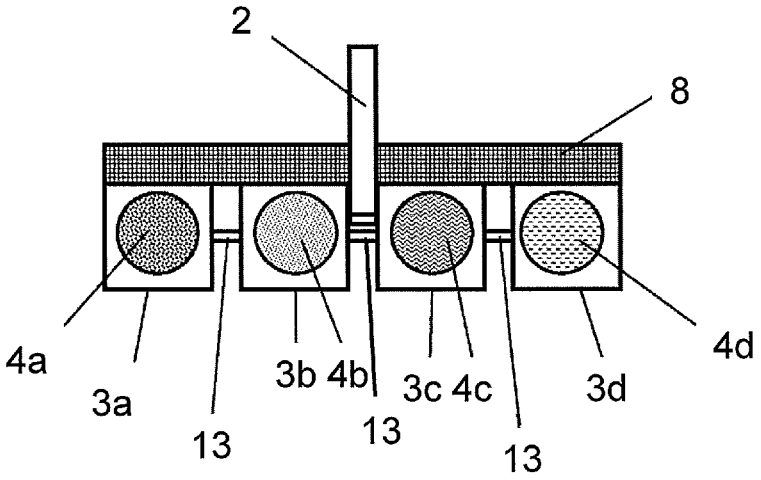
FIG. 3 depicts a top view of a toilet basket with containers arranged adjacent to one another in a row, and a flush water distribution element.

FIG. 3 shows the top view of a further embodiment of a toilet basket comprising four containers 3*a-d* arranged in a row adjacent one another, and a flush water distribution element 8. As suggested by the different shading/hatch marks in the illustrations of the toilet cleaner blocks 4*a-d*, the containers 3*a-d* may hold preparations 4*a*, 4*b*, 4*c*, 4*d* that differ in composition from one another. Adjacent containers 3*a-d* may be physically supported and connected to one another by a non-water conducting connection 13.

Figure 4:
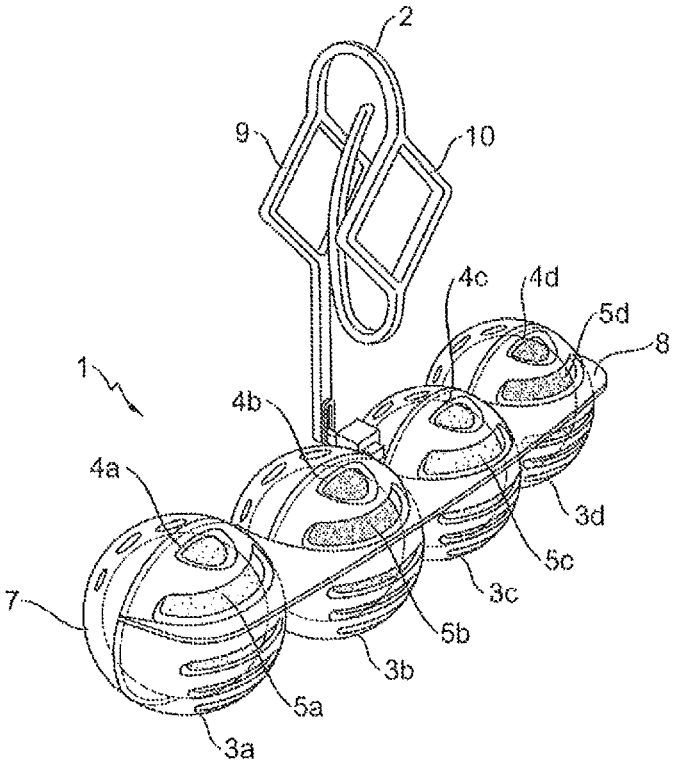
FIG. 4 depicts a perspective view of a toilet basket useable for solid or gel-like preparations with near spherical containers and a flush water distribution element.

FIG. 4 is a top, perspective view of another embodiment of a release device 1 made of transparent material and comprising spherical containers 3*a-d* usable to hold toilet cleaner blocks 4*a-d*, and also comprising a flush water distribution element 8. The four containers 3*a-d* are arranged in a row. Spherical, solid preparations 4*a-d* are held in the transparent containers 3*a-d*, and these preparations are optionally different in composition. The transparent design of the containers 3*a-d* allows the consumer to determine visually and easily the degree of consumption of the preparations 4*a-d*.

Figure 5:
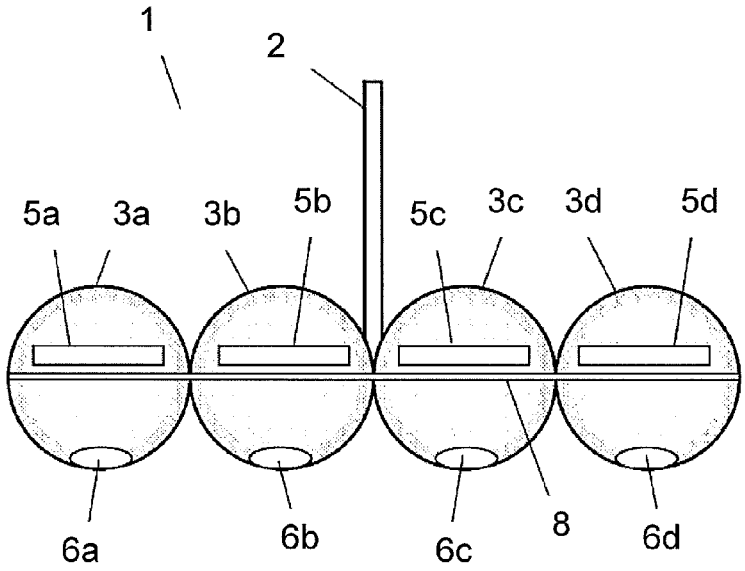
FIG. 5 depicts a front view of a toilet basket usable for solid or gel-like preparations having near spherical containers and a flush water distribution element.

The plate-like flush water distribution element 8 that runs at about the level of the longitudinal axis is arranged below the slit shaped inlets 5*a-d* of the containers 3*a-d* and extends over the total length of the toilet basket; this is clearly discernible from the frontal view in FIG. 5 of the toilet basket shown in FIG. 4.

The containers 3*a-d* and the distribution element 8 are preferably formed in one piece. That is, the containers 3*a-d* may be comprised of two half shell-like elements that are connected with a hinge-like material bridge, and are preferably molded in an injection molding process wherein the flush water distribution element 8 is molded on one of the half shell-like elements. The containers 3*a-d* are then formed by folding together both half shell-like elements, wherein the elements when folded together are fixed to one another by a suitable form/friction fit or other cohesive connection.

The one-piece retaining element 2, by which the release device 1 can be fixed on the rim of a toilet bowl, may comprise two diamond-shaped spring elements 9, 10, wherein in the inserted state of the toilet release device 1 in the toilet, the first spring element 9 has an essentially vertical spring deflection path and the second spring element 10 has an essentially horizontal spring deflection path. The spring deflection paths thus provided enable the toilet basket to be better and more flexibly fixed on toilets that have bowl rims of different thicknesses and designs.

The mechanism of operation of the spherical containers 3*a-d* in conjunction with the flush water distribution element 8 is explained in more detail with reference to FIG. 6.

Figure 6:
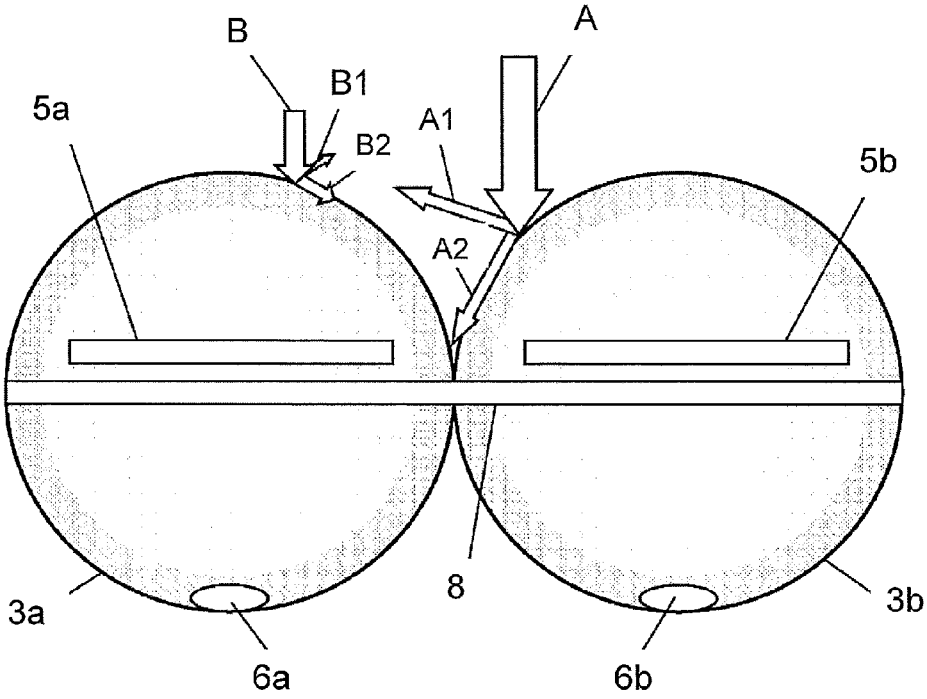
FIG. 6 depicts schematic view of a toilet basket for solid or gel-like preparations having near spherical containers that can be impacted by flush water.
Figure 7:
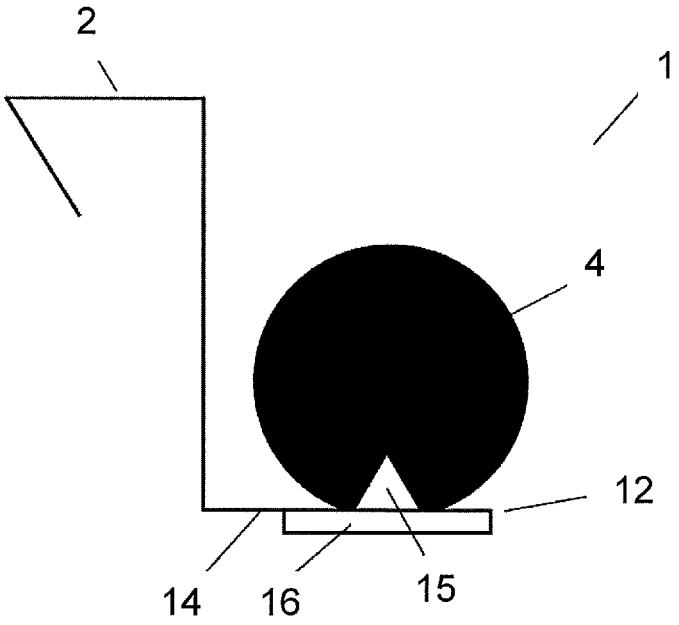
FIG. 7 depicts a plate-shaped release device with a toilet cleaner block.

In FIG. 6, a first flush water flow that impinges on the spherical containers is illustrated in the schematic illustration by arrow "A", wherein the width and length of the arrow A symbolize the amount of flush water and the velocity of the flush water respectively. If the flush water flow meets the spherical surface of the container, then the impinging flush water flow is broken up, i.e. one part is deflected and produces a water splash part that is signified by the smaller arrow A1, and a part is channeled away over the surface of the container and symbolized by the smaller arrow A2.

As a further example of the mechanism of operation, a second flush water flow B is shown in FIG. 6 having a lower flush water velocity and amount than the flush water flow A; the flow B is thus illustrated to have shorter and narrower arrows to denote the lower velocity and amount. For a lower flush water velocity and amount, the splash water fraction on meeting the spherical surface is reduced, and the amount of flush water that, after impinging the spherical container surface, flows over it is increased.

If now one of the spherical containers in the installed state of the toilet basket in the toilet lays in a section with a high and strong flush water impingement, then a greater fraction of splash water is produced that then distributes flush water onto the adjacent spherical containers, where it runs off over the surfaces of the spherical containers or arrives directly into the inlets of the containers. In the region of lower flush water impingement, less splash water is produced by the spherical design of the container, and a greater fraction of flush water runs off over the container surface. In this way a uniform discharge of flush water into the inlets of the container is achieved.

The flush water distribution element has a similar effect; in the installed state of the toilet basket it acts as a sort of baffle plate in the flush water flow. In regions of a high and strong flush water impingement, a greater fraction of splash water is produced than in regions of weaker flush water impingement, such that a uniform discharge of the flush water is created over the surface of the flush water distribution element into the inlets of the container.

A uniform washing away of the preparations is achieved by the configuration of spherical containers and flush water distribution element, particularly the degree, in which the spherical containers lay partially or completely in the flush water flow, the size and design of the inlets of the container as well as the size and location of the flush water distribution element.

In this regard it is preferred that the spherical containers 3*a*, 3*b* are designed to receive spherical preparations with a diameter of 25-40 mm. Moreover, the depth of the flush water distribution element 8 is preferably between 2 and 20 mm, particularly preferably between 5 and 15 mm, wherein depth is understood to mean the horizontal extension in the suspended state of the flush water distribution element 8 towards the flush water impinged toilet rim. It is of further advantage to arrange the flush water distribution element 8 in or above the horizontal to the section plane through the center of the spherical containers 3*a*, 3*b*. In a preferred development of the invention, the gap between the upper edges of the flush water inlets 5*a*, 5*b* of the spherical containers 3*a*, 3*b* and the flush water distribution element 8 is between 2 mm and 8 mm. In addition, horizontally running slits are to be preferred as the flush water inlets 5*a*, 5*b*, wherein the slits preferably have a height between 1-6 mm, preferably 2-4 mm, and a width of 5-35 mm, preferably 20-25 mm.

FIG. 7 shows an inventive release device 1 comprising a bow-like retaining element 2 that is provided for fastening and attaching the release device 1 on the rim of a toilet. A receiver 12 that serves to receive the toilet cleaner block is arranged on the distal end 14 (that points towards the inside of the toilet) of the retaining element 2 in the fixed state of the release device 1 on the rim of the toilet. It is also possible to arrange a plurality of receivers for the same or different toilet cleaner blocks on the retaining element 2.

The receiver 12 consists of a plate 16, from which at least one spike 15 extends vertically. A toilet cleaner block 4 is fixed onto the spike 15 by pushing it on, wherein the toilet cleaner block 4 lays at least partially on the plate 16, such that the toilet cleaner block 4 is sufficiently well fixed in the receiver 12. It is also possible to arrange a plurality of spikes on a plate 16 for fixing a toilet cleaner block. In this way, one can avoid forming an enclosing basket.

The embodiment shown in FIG. 7 of a release device and a toilet cleaner block allows a release device 1 having the lowest possible material requirement and at the same time a pleasing esthetic aspect to be fixed in a toilet bowl. Furthermore, the embodiment illustrated allows a simple refilling of the release device 1, such that once the cleaner block 4 has been flushed away, a new toilet cleaner block can be inserted by simply slipping it into the receiver 12 of the release device 1.

By preventing any swelling up of the toilet cleaner block 4, the toilet cleaner block 4 can be securely fixed in the receiver 12 even after a large number of flush cycles.

The release device 1 is preferably configured such that in the installed position the plate 16 is essentially horizontal and the spike 15 is essentially vertical. This prevents the toilet cleaner block 4 from slipping out of the receiver 12 when impacted by flushing water, in particular after several flush cycles and the associated wearing away of the toilet cleaner block 4.

The spike can have any shape that enables the toilet cleaner block 4 to be suitably mounted on it without causing the toilet cleaner block 4 to mechanically disintegrate. In particular the spike 15 can be designed to be cylindrical, conical, pyramidal, screw-like or similarly shaped. Furthermore, the spike 15 can be barbed (not shown in FIG. 7), which prevents it from being removed from the receiver 12 once the toilet cleaner block has been mounted.

In a preferred embodiment, the toilet basket depicted in the FIGS. 1 to 6 may be equipped with a childproof closure in order to prevent the improper use of the inventive spherical toilet cleaner block.

The toilet cleaner block according to the invention is manufactured in a process that includes the steps:

a) mixing the ingredients;

b) extruding the mixture;

c) cutting the extruded strand into pieces of a defined mass; and d) shaping into rotationally symmetric objects.

The shaping step (d) is preferably carried out in a ball rolling machine or in a press. Other suitable shaping processes include casting and calendaring. Steps (a) and (b) can also be combined by mixing the ingredients in the extruder. The process steps optionally proceed at different temperatures, such that heating or cooling steps can also be interposed between the steps as necessary.

In a preferred embodiment, subsequent to one of the steps (b) or (c), an additional process step is carried out in which the extruded strand is provided with a lubricant. For this a sponge, in the form of a roller that is permanently charged with the lubricant, is guided over the extruded strand such that the surface is completely or partially, preferably to 10 to 40%, covered with lubricant. The addition of lubricant improves the subsequent molding into the spherical shape. Suitable lubricants are especially substances that for example are added as surfactants or flush regulators in inventive formulations. In this regard, an added lubricant is preferably selected from the group consisting of dipropylene glycol, paraffins, non-ionic surfactants, polyethylene glycols, and mixtures thereof, and especially dipropylene glycol.

The toilet cleaner bock particularly preferably exhibits a sphericity $\Psi$ between 0.8 and 1, particularly preferably between 0.85 and 1, and quite particularly preferably between 0.9 and 1.

EXAMPLES

Referring now to TABLE 1, an inventive toilet cleaner block was manufactured with the formulation E1. In addition, control formulations V1 to V4 were also manufactured. Experiments were carried out with all compositions to extrude the mixtures, to cut a piece of defined mass from the extruded strand, and to form the pieces into spheres using a rolling machine. It was observed that the formulations V1, V2 and V4 were too soft, with difficulties appearing in the extrusion and/or shaping steps. Furthermore, the resulting products from shaping of V1, V2 and V4 swelled up during the toilet flushing tests. V3 could be satisfactorily extruded and shaped into spheres, and the swelling behavior of the shaped product was better, but the extrusion had to be carried out at high temperatures, thereby leading to unwanted high losses of perfume. In contrast, the inventive cleaner block with composition E1 could be extruded and shaped at a less than 30° C., with the final blocks showing no swelling during the toilet flushing cycles.

The formulations E1 and V1 to V4 are summarized in TABLE 1. All ingredient quantities are listed in wt %.

TABLE 1

Exemplary Toilet Cleaner Block Compositions

| | Formulations | | | | |
|---|---|---|---|---|---|
| Ingredients (wt. %) | E1 | V1 | V2 | V3 | V4 |
| $C_{10-13}$ linear alkylbenzene sulfonate-Na | 26 | — | 12.4 | 21 | — |
| Fatty alcohol sulfate-Na | — | 7.4 | — | — | — |
| $C_{12}$ fatty alcohol sulfate-Na | — | 17.4 | 12.4 | — | — |
| $C_{14-16}$ olefin sulfate-Na | 18 | — | — | 23 | 20 |
| $C_{16-18}$ fatty alcohol ethoxylate 25 EO | 8 | 17 | 17 | — | 17 |
| Cellulose | — | 3 | — | — | — |
| Trisodium citrate dehydrate | 1 | 2 | 2 | 0.3 | 2 |
| Sodium carbonate | — | 0.95 | 0.95 | — | 0.95 |
| $C_{12-18}$ fatty acid monoethanolamide | — | 8 | 15 | — | 15 |
| Sodium silicate | — | — | — | 3 | — |
| Perfume | 4.5 | 4 | 4.5 | 4.5 | 4.5 |
| Colorant | + | + | + | + | + |
| Sodium sulfate | q.s. | q.s. | q.s. | q.s. | q.s. |

We claim:

1. A malleable toilet cleaner composition comprising:

a) perfume;

b) at least one nonionic surfactant;

c) at least one alkyl benzene sulfonate; and d) at least one olefin sulfonate; and e) at least one inorganic alkali metal salt or alkaline earth metal salt at a concentration of 35 to 55 wt.% of the composition, wherein said composition is sufficiently malleable to be shaped at temperatures less than 30° C. into a rotationally-symmetrical object using a rolling machine or a press.

2. The composition of claim 1, wherein said alkyl benzene sulfonate is present at from about 10 wt.% to about 70 wt.%.

3. The composition of claim 2, wherein said alkyl benzene sulfonate is present at from about 20 wt.% to about 30 wt.%.

4. The composition of claim 1, wherein said olefin sulfonate is present at from about 10 wt.% to about 30 wt.%.

5. The composition of claim 4, wherein said olefin sulfonate is present at from about 15 wt.% to about 25 wt.%.

6. The composition of claim 1, wherein said at least one nonionic surfactant is a fatty alcohol ethoxylate.

7. The composition of claim 6, wherein said fatty alcohol ethoxylate is present at from about 7 wt.% to about 9 wt.%.

8. The composition of claim 1, wherein said at least one nonionic surfactant comprises at least a fatty acid monoethanolamide.

9. The composition of claim 1, further comprising a surfactant chosen from the group consisting of fatty alcohol sulfate, fatty alcohol ether sulfate, alkane sulfonate, and mixtures thereof.

10. The composition of claim 1, further comprising at least one additional ingredient selected from the group consisting of acids, bases, salts, thickeners, antimicrobials, preservatives, sequestrants, colorants, scents, perfume boosters, fillers, builders, bleaching agents, corrosion inhibitors, flush regulators, enzymes, microorganisms, active substances for biofilm removal, lime-scale inhibitors, soil-adhesion inhibitors, and mixtures thereof.

11. The malleable toilet cleaner composition of claim 1, wherein the at least one nonionic surfactant, the at least one alkyl benzene sulfonate, and the at least one olefin sulfonate have a combined concentration of at least 42% by weight of the composition.

12. The malleable toilet cleaner composition of claim 11, wherein the at least one nonionic surfactant, the at least one alkyl benzene sulfonate, and the at least one olefin sulfonate have a combined concentration of at least 50% by weight of the composition.

* * * * *